US005749034A

United States Patent [19]

Folkins

[11] Patent Number: 5,749,034

[45] Date of Patent: May 5, 1998

[54] TRANSFER, CLEANING AND IMAGING STATIONS SPACED WITHIN AN INTERDOCUMENT ZONE

[75] Inventor: Jeffrey J. Folkins, Rochester, N.Y.

[73] Assignee: Xerox Corporation, Stamford, Conn.

[21] Appl. No.: 775,339

[22] Filed: Jan. 21, 1997

[51] Int. Cl.[6] ..... G03G 15/16

[52] U.S. Cl. ..... 399/303; 399/313; 399/316

[58] Field of Search ..... 399/298, 303, 399/310, 313, 314, 316, 344, 345, 301

[56] References Cited

U.S. PATENT DOCUMENTS

| | | | |
|---|---|---|---|
| 5,200,891 | 4/1993 | Dastin et al. | 399/301 |
| 5,287,160 | 2/1994 | Dastin et al. | 399/301 |
| 5,392,104 | 2/1995 | Johnson | 399/301 |
| 5,493,383 | 2/1996 | Pozniakas et al. | 399/345 |
| 5,574,540 | 11/1996 | Folkins | 399/171 |
| 5,576,824 | 11/1996 | Folkins . | |
| 5,579,089 | 11/1996 | Folkins . | |
| 5,579,100 | 11/1996 | Yu et al. . | |
| 5,581,330 | 12/1996 | Pietrowski et al. . | |

*Primary Examiner*—Matthew S. Smith

[57] ABSTRACT

Apparatus for implementing discharge and develop, REaD IOI electrostatic printing machines that determine image area charge potentials of without using potentials within interdocument zones. The apparatus operates by charging a photoreceptor's image area to a charge potential, interrogating the image data to be used to produce a latent image on that charged image area to identify a white section, exposing the charged image area according to the image data to form a latent image, determining the potential of the white section of the latent image, and equating the potential of the white section to the charge potential. Thus, the printing machine includes a photoreceptor having a charge retentive surface of a sufficient length to hold a plurality of image areas; a charging station charging one image area to a potential that is to be determined; an image data source producing a digital representation of a latent image that is to be produced; an exposure station exposing the image area to produce a latent image; a data interrogator for identifying white sections; and an electrostatic voltmeter for measuring the potential of the identified white area.

8 Claims, 2 Drawing Sheets

TRANSFER, CLEANING AND IMAGING STATIONS SPACED WITHIN AN INTERDOCUMENT ZONE

FIELD OF THE INVENTION

This invention relates to image-on-image electrophotographic printers. In particular, it relates to advantageous spacing of the transfer, cleaning and imaging stations in such printers.

BACKGROUND OF THE INVENTION

Electrophotographic printing is a well known method of producing documents. That method is typically performed by exposing a substantially uniformly charged photoreceptor with a light image representation of a desired document. In response, the photoreceptor is discharged so as to create an electrostatic latent image of a desired final image on the photoreceptor's surface. Toner particles are then deposited onto the latent image to form a toner image. That toner image is then transferred from the photoreceptor, either directly or after an intermediate transfer step, onto a substrate such as a sheet of paper. The transferred toner image is then permanently fused to the substrate using heat and/or pressure, thus producing the desired final image. The surface of the photoreceptor is then cleaned of residual developing material and recharged in preparation for the creation of another image.

The process described above can be modified to produce color images. In an exemplary color printing process, which may be referred to as the multipass intermediate belt process, a first toner layer is produced using a first color of toner, that first toner layer is then transferred onto an intermediate belt, then a second toner layer is developed using a second color of toner, and that second toner layer is then transferred onto the intermediate belt in superimposed registration with the first toner layer. The process then repeats for third and fourth toner layers which are comprised of third and fourth colors of toner. After all of the toner layers are transferred to the intermediate belt a composite toner image results. That composite toner image is then transferred and fused onto a substrate.

In the multipass intermediate belt process the development of each toner layer is essentially independent of the development of the other toner layers. This is beneficial since the developing stations can be set up to produce the desired target toner masses for each color of toner independently of the other developing stations.

In another color electrophotographic printing process, referred to herein as the REaD IOI process (which stands for the Recharge, Expose, and Develop, Image-On-Image process), the various toner images are developed in a superimposes relationship on the photoreceptor itself. Only after the composite toner image is formed are the toner layers transferred from the photoreceptor. More detailed descriptions of the REaD IOI process are found in U.S. Pat. No. 5,574,540; U.S. Pat. No. 5,579,100; U.S. Pat. No. 5,576,824; U.S. Pat. No. 5,579,089; and U.S. Pat. No. 5,581,330 and the references therein.

While the REaD IOI process is beneficial in that eliminating the multiple transfer steps potentially enables a lower cost, physically smaller printer, such advantages are not automatically realized. To achieve those advantages requires implementation of a specific REaD IOI architecture. A particularly advantageous REaD IOI architecture is the five cycle architecture.

A five cycle architecture produces a final image in 5 cycles, or passes, of the photoreceptor rather than the more traditional four cycles. During the first four cycles of both the four and five cycle printers, four different color images are produced on the photoreceptor as explained above. In a four cycle printer the composite image is transferred and the photoreceptor is cleaned during the fourth cycle. However, in a five cycle printer the composite image is beneficially transferred and the photoreceptor is cleaned in a fifth cycle. While five cycle printers generally have less throughput than four cycle printers, five cycle printers can be implemented at lower cost because various components, such as the photoreceptor chargers, can be used for multiple purposes, such as detacking.

While accepting lower cost, lower performance is frequently desirable, once the decision is made to implement a five cycle architecture it is sometimes beneficial to achieve as much performance as possible within the cost constraints. To this end, rather than implementing a printer that produces only one image at a time it is common to design printers such that their photoreceptors hold a plurality of latent images/toner layers. Whether one utilizes a single or a plural image archtecture implementation, the region on the photoreceptor between different images or colors is referred to as the interdocument zone. The closer the latent images are spaced, or in other words the smaller the interdocument zone, the more compact the photoreceptor, and thus the printer, can be.

Implementing high quality imaging with the multipass REaD IOI process in a printer is particularly difficult because during the last cycle the image is transferred and the photoreceptor is cleaned. Transferring and cleaning tend to load the photoreceptor and cause a photoreceptor motion quality disturbance such that if another image or portion of same image is simultaneously being exposed then a degradation of that image can be expected. Even if another image is not being exposed during transfer or cleaning, surface torque that occur during transfer and cleaning can cause motion problems on a photoreceptor belt that last for a short period of time.

Therefore, multi-cycle printer architectures that reduce or eliminate imaging defects caused by transferring and or cleaning would be beneficial.

SUMMARY OF THE INVENTION

The principles of the present invention provide for five cycle REaD IOI electrostatic printing machines that have reduced imaging defects caused by actions during the fifth cycle. A printing machine according to the principles of the present invention has its exposure station, imaging station, and cleaning station all located substantially within an interdocument zone. Beneficially, the exposure station, the imaging station, and the cleaning station are all located adjacent a roller, preferably the driven roller.

BRIEF DESCRIPTION OF THE DRAWINGS

Other aspects of the present invention will become apparent as the following description proceeds and upon reference to the drawings, in which.

DETAILED DESCRIPTION OF THE PREFERRED EMBODIMENTS

Figure 1:
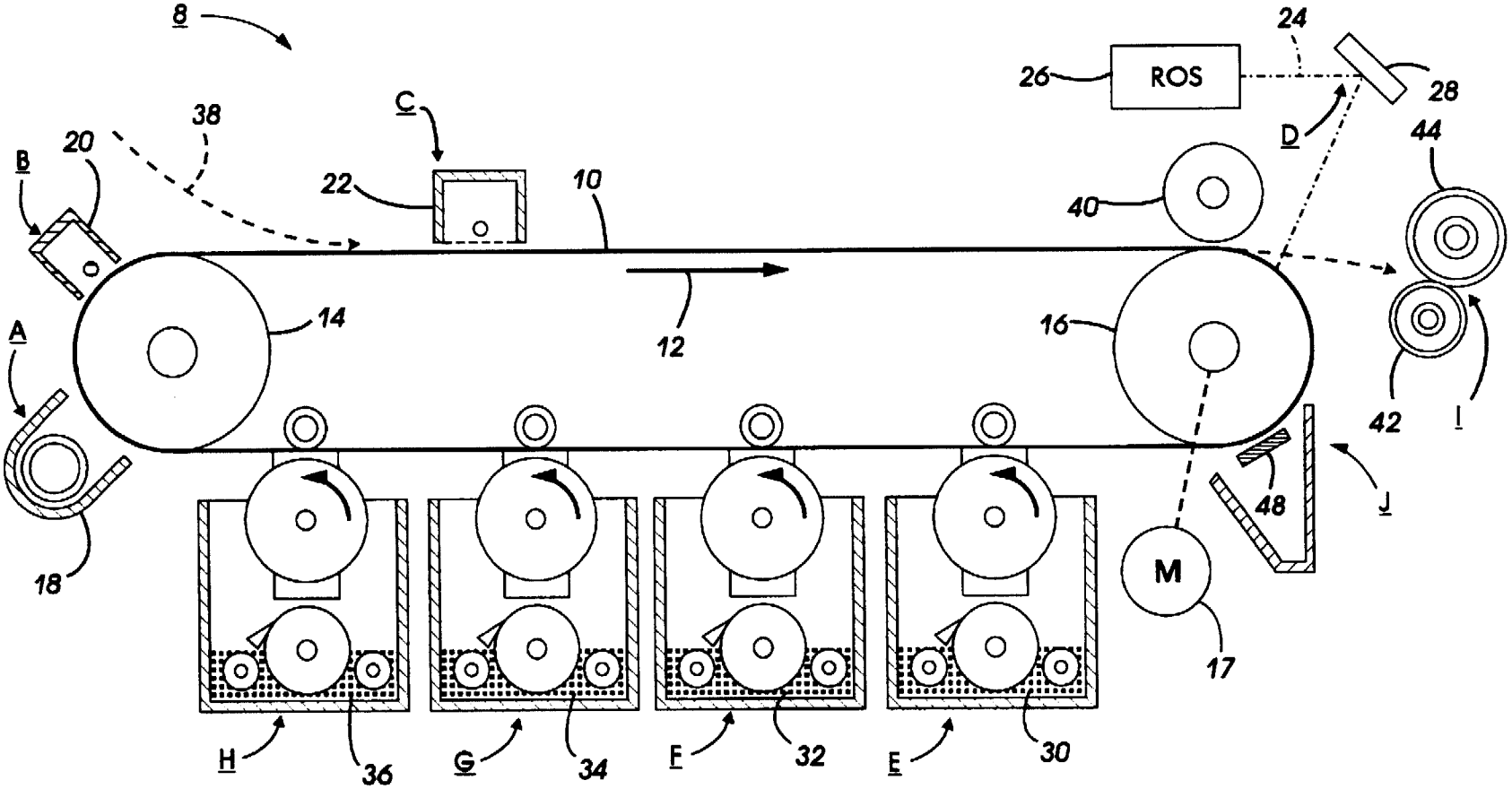
FIG. 1 is a schematic illustration of an electrophotographic printing machine which incorporates the principles of the present invention.

The preferred embodiment of the present invention includes a plurality of individual subsystems which are known in the prior art, but which are organized in a novel, nonobvious, and beneficial way. FIG. 1 illustrates a discharge-area-development, recharge-expose-and develop, image-on-image, color, electrophotographic printing machine 8 which is suitable for implementing the principles of the present invention. U.S. patent application Ser. No. 08/472,164, entitled "FIVE CYCLE IMAGE ON IMAGE PRINTING ARCHITECTURE," which was filed on 7 Jun. 1995, and the references cited in the "BACKGROUND OF THE INVENTION" provide further information on this type of printing machine.

Figure 2:
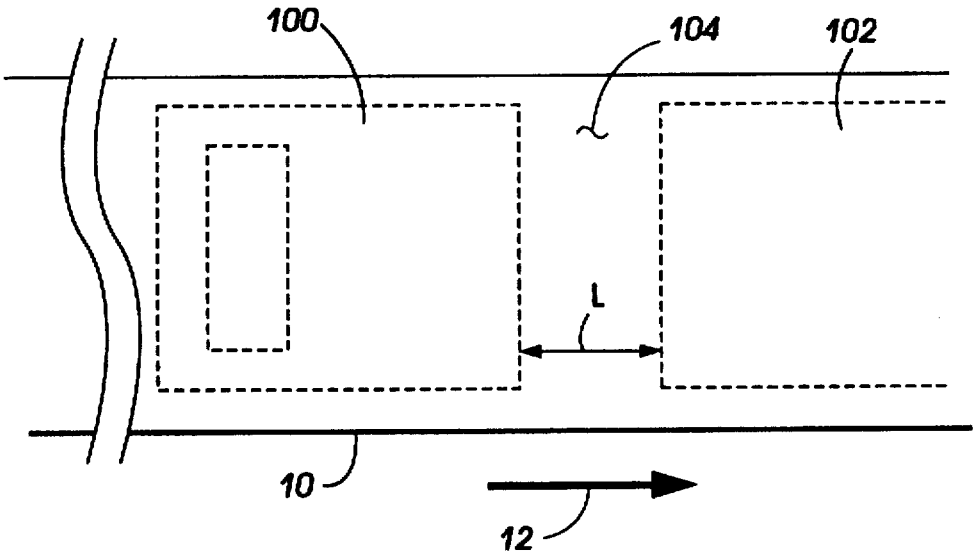
FIG. 2 presents a schematic view of an interdocument zone.

The printing machine 8 includes an Active Matrix (AMAT) photoreceptor belt 10 which travels in the direction indicated by the arrow 12. Belt travel is brought about by mounting the belt about a tension roller 14 and a drive roller 16 which is driven by a motor 17. As the photoreceptor belt travels each part of it passes through each of the subsequently described process stations. For convenience, sections of the photoreceptor belt, referred to as image areas, are identified. An image area is that part of the photoreceptor belt that is to be exposed and developed, as subsequently explained, to produce a composite image. Turning now to FIG. 2, it is to be understood that the photoreceptor belt 10 may include more than one image area. For example, FIG. 2 shows a first image area 100 and a second image area 102 that are separated by an interdocument zone 104 of a length L. The existence and length of the interdocument zone is significant to the present invention. Even if the photoreceptor belt 10 has only one image area it still has an interdocument area separating the lead and trail edges of the image. There will be an equal number of interdocument zones as image areas.

As previously mentioned, the printing machine 8 is a five cycle machine. Turning back to FIG. 1, a first cycle begins with an image area passing through an erase station A. For convenience, it will be assumed that it is the image area 102 that is passing through the erase station A. At erase station A an erase lamp 18 illuminates the image area 102 so as to cause any residual charge which might exist on the image area 102 to be discharged. Such erase lamps and their use in erase stations are well known. Light emitting diodes are commonly used as erase lamps.

As the photoreceptor belt continues its travel the image area 102 passes through a first charging station B (and the image area 100 advances to the erase station A for erasure as described above). At the first charging station B a corona generating device 20, beneficially a DC pin scorotron, charges the image area 102 to a relatively high and substantially uniform potential of, for example, about −450 volts. After passing the corona generating device 20 the image area 102 passes through a second charging station C which partially discharges the image area 102 to, for example, about −400 volts. The second charging station C uses an AC scorotron 22 to generate the required ions. For reasons that will become apparent, the first and second charging stations are referred to together as a recharging station.

The use of a first charging station to overcharge the image area and a subsequent second charging station to neutralize the overcharge is referred to as split charging. A more complete description of split charging may be found in co-pending and commonly assigned U.S. patent application, "Split Recharge Method and Apparatus for Color Image Formation," Ser. No. 08/347,617. Since split charging is beneficial for recharging a photoreceptor which has a developed toner layer, and since the image area 102 does not have such a toner layer during the first cycle, split charging is not required during the first cycle. If split charging is not used in the first cycle either the corona generating device 20 or the scorotron 22 corona could be used to simply charge the image area to the desired level of −400 volts.

Returning now to FIG. 1, after passing the second charging station C the image area 102 passes a roller 40, whose operation is explained subsequently, and into an exposure station D. Meanwhile, the image area 100 passes by the first and second charging stations. Significantly, the roller 40 and the exposure station are adjacent the drive roller 16. At exposure station D the charged image area 102 is exposed by the output 24 of a laser based output scanning device 26 which reflects from a mirror 28. The scanning device discharges some parts of the image area so as to produce an electrostatic latent representation of a first color of image (beneficially black) on the image area 102. The exposed part of the image area 102 might be discharged to about −50 volts. Thus, after exposure the image area will have a voltage profile comprised of sections at a relatively high voltage of about −400 volts and a section at a relatively low voltage of about −50 volts.

The electrostatic latent image produced on the image area 102 is derived from information that represents one color of the image. That data source might be an input scanner, a computer, a facsimile machine, a memory device, or any of a number of other image data source. As in the prior art, the image data for the latent image modulates the ROS intensity to produce the electrostatic latent image.

After the image area 102 advances through the exposure station D that image area passes a cleaning station J that includes a cleaner blade 48 that is adjacent the drive roller 16. The operation of the cleaning station is described subsequently. After passing the cleaning station the image area 102 advances to a first development station E. Meanwhile, the image area 100 is exposed by the exposure station D. The first development station E contains a toner 30 of a first color, beneficially black. Black is beneficial since the subsequently described colored toner particles are not normally written over black toner, and therefore residual toner voltages are not a problem over black toner. While the first development station E could be a magnetic brush developer, a scavengeless developer may be somewhat better. Scavengeless development is well known and is described in U.S. Pat. No. 4,984,019 entitled, "Electrode Wire Cleaning," issued 3 Jan. 1991 to Folkins; in U.S. Pat. No. 4,868,600 entitled "Scavengeless Development Apparatus for Use in Highlight Color Imaging," issued 19 Sep. 1989 to Hayes et al.; in U.S. Pat. No. 5,010,367 entitled "Dual AC Development System for Controlling The Spacing of a Toner Cloud," issued 23 Apr. 1991 to Hays; in U.S. Pat. No. 5,253,016 entitled, "Contaminant Control for Scavengeless Development in a Xerographic Apparatus," issued on 12 Oct. 1993 to Behe et al.; and in U.S. Pat. No. 5,341,197 entitled, "Proper Charging of Doner Roll in Hybrid Development," issued to Folkins et al. on 23 Aug. 1994. Those patents are hereby incorporated by reference.

One benefit of scavengeless development is that it does not disturb previously deposited toner layers. Since during the first cycle the image area does not have a previously developed toner layer, the use of scavengeless development is not absolutely required as long as the developer is physically out of contact during other cycles. However, since the other development station (described below) use scavengeless development it may be better to use scavengeless development at each development station.

After passing the first development station E, the image area 102 returns to the first charging station B and the image area 100 is developed by the developing station E. The second cycle then begins for the image area 102. The first charging station B uses its corona generating device 20 to overcharge the image area 102 and its first toner layer to a more negative voltage levels than that which they are to have when they are next exposed. For example, the image area 102 and its first toner patch may be charged to a potential of about −350 volts. The image area 102 then advances once again to the second charging station C. The second charging station C reduces the charge on the image area 102, leaving the image area potential at about −300 volts. This split recharging is effective in reducing the residual toner voltage which develops after the second exposure, described below. Meanwhile, the image area 100 begins its second cycle by being recharged by the charging station B.

After the image area 102 passes the second charging station C, both the first toner layer and the untoned part of the image area again advance past the roller 40 and into the exposure station D. At exposure station D the image area 102 is again exposed to the output 24 of a laser based raster output scanning device 26 that is modulated in accord with image data. However, during this cycle the scanning device 26 is modulated with information that represents a second color image, say yellow.

After passing through the exposure station D the exposed image area 102 again advances past the cleaning blade 48 and to a second development station F. Meanwhile, the image area 100 is exposed by the exposure station D The second development station F contains a toner 32 of a second color, assumed to be yellow. As indicated above, the second development station F beneficially uses a scavengeless developer.

After passing through the second development station F, the image area 102 returns once again to the first charging station B and to the second charging station C. The third cycle then begins. Meanwhile, the image area 100 is developed by the development station F. Again, the first charging station B overcharges the image area 102 and its toner layers to more negative voltage levels than that which they are to have when they are next exposed, and the second charging station reduces that charge potential to a predetermined value, say −350 volts.

The recharged image area 102 then passes once again past the roller and into the exposure station D. Meanwhile, the image area 100 is recharged by charging stations B and C. At the exposure station D the recharged image area 102 is again exposed to the output 24 of a laser based output scanning device 26. However, during this cycle the scanning device 26 is modulated with information that represents a third color image, say magenta. The image area 102 then again passes the cleaning blade 48 and advances to a third development station G. Meanwhile, the image area 100 is exposed by the exposure station D. The third development station G, which contains a toner 34 of a third color, assumed to be magenta, develops the image area 102. As indicated above, the third development station G beneficially uses a scavengeless developer.

After passing through the third development station G, the image area 102 returns once again to the first charging station B and to the second charging station C. The fourth cycle for image area 102 then begins Meanwhile, the image area 100 is developed by the development station G. Once again, the first charging station B overcharges the image area 102 and its toner layers to more negative voltage levels than that which they are to have when they are next exposed, and the second charging station reduces the charge potential substantially to a predetermined value, say −450 volts.

The recharged image area 102 then passes the roller 40 and once again advances into the exposure station D. Meanwhile, the image area 100 is recharged by the charging stations B and C. At the exposure station D the recharged image area 102 is once again exposed to the output 24 of a laser based output scanning device 26. Again the raster output scanning device 26 is modulated in accord with image data. However, during this cycle the scanning device 26 is modulated with information that represents a fourth color image, say cyan. The image area 102 then again passes the cleaning brush 48 and advances to a fourth development station H, which develops the latent image area 102 using a toner 36 of a fourth color, assumed to be cyan. As indicated above, the fourth development station H beneficially uses a scavengeless developer. Meanwhile, the image area 100 is exposed by the exposure station D.

After completing the fourth cycle the image area 102 has four toner powder images which make up a composite color powder image. That composite color powder image is comprised of individual toner particles which have charge potentials which vary widely. Indeed, some of those particles have a positive charge. Transferring such a composite toner layer onto a substrate would result in a degraded final image. Therefore it is necessary to prepare the charges on the toner layer for transfer. This preparation is performed during a fifth cycle.

The fifth cycle begins by passing the image area 102 once again past the erase station A. At erase station A the erase lamp 18 discharges the image area 102 to a relatively low voltage level. This reduces the potential of the image area 102, including that of the composite color toner image, to potentials near zero. The image area then passes once again to the charging station B. During this fifth cycle the charging station B performs pretransfer charging. That is, the first charging device supplies sufficient negative ions to the image area 102 such that substantially all of the previously positively charged toner particles are reversed in polarity.

After the image area travels past the first charging station B and the second charging station C, a substrate 38 is advanced into place over the image area 102 using a sheet feeder which is not shown. As the image area 102 and its overlying substrate continues their travel they pass the bias transfer roll 40. Meanwhile, the image area 100 begins its fifth cycle by passing the erase station A. The bias transfer roll 40 is now charged so as to assist attracting the toner particles on the image area 102 onto the substrate and to assist separating the substrate and the composite toner image from the photoreceptor 10.

After separation the substrate 38 is directed into a fuser station I where a heated fuser roll 42 and a pressure roller 44 create a nip through which the substrate passes. The combination of pressure and heat at the nip causes the composite color toner image to fuse into the substrate 38. After fusing, a chute, not shown, guides the support sheets 38 to a catch tray, also not shown, for removal by an operator.

Meanwhile a second substrate 38 is advanced over the image area 100 somewhat before the image area 100 reaches the second charging station. The image area 100 and the second substrate then advance toward the bias transfer roller 40. However, before the image area 100 and the substrate arrive, the image area 102 enters the cleaning station J. At cleaning station J the cleaning blade 48 is brought into contact with the image area 102 such that the cleaning blade removes residual toner particles from the image area 102. After the image area 102 is cleaned it advances toward the erase station 18 for the beginning of another first cycle.

Meanwhile, the image area 100 passes the bias transfer roller 40, the second substrate and the toner image are separated from the photoreceptor, the toner is fused to the second substrate at the fuser station I, and the image area 100 is cleaned in the same manner as the image area 102. Significantly, the composite image on the image area 100 is transferred and fused, and the image area 100 is cleaned before the image area 102 is exposed during the next first cycle.

From the above it can be seen that neither image area 100 nor 102 is exposed when the other image area is being transferred or cleaned. To this end, the principles of the present invention provide for locating the transfer and cleaning stations, and for operating those stations, such that neither cleaning station nor transfer occur during exposure of either image area 100 or 102. This is important because transferring and/or cleaning are often performed in a manner such that a transitional load is placed on the photoreceptor drive train. Such a load might produce torques on the drive train such that image quality might be degraded. Disturbances in the motion drive or speed of the photoreceptor during imaging is the most sensitive and leads most directly to image quality defects.

Therefore, according to the principles of the present invention the transfer station and the cleaning station are located and dimensioned such that the physical interactions of those stations with the photoreceptor 12 occur within an interdocument zone 104 (see FIG. 2). This implies that those physical interactions take place within a distance L. Beneficially, to reduce residual torque, the transfer and cleaning stations are located adjacent the driven roller 16. Even more beneficially, exposure of the photoreceptor occurs such that physical interactions of the transfer and cleaning station with the photoreceptor, together with the exposure position, that is, the location where the photoreceptor is exposed by the exposure station, occurs within the length of an interdocument zone.

It is to be understood that while the figures and the above description illustrate the present invention, they are exemplary only. Furthermore, others who are skilled in the applicable arts will recognize numerous modifications and adaptations of the illustrated embodiments which will remain within the principles of the present invention. Therefore, the present invention is to be limited only by the appended claims.

What is claimed:

1. An electrophotographic printing machine, comprising:

a rotating photoreceptor having an image area for receiving toner and an interdocument zone of a length L;

a charging station for charging said image area to a predetermined potential;

an exposure station for exposing said image area with image data;

a plurality of N developers that are capable of producing N toner images on said image area in N cycles of said image area;

a transfer station for transferring toner images on said image area to a substrate during an N+1 cycle; and a cleaning station for cleaning said image area after said toner images are transferred to a substrate;

wherein physical contact between both said transfer station and said cleaning station with said photoreceptor occur within the distance L, and wherein said exposure station exposes said photoreceptor when said transfer station and said cleaning station are not both adjacent said interdocument zone.

2. A printing machine according to claim 1, wherein said photoreceptor is comprised of a belt that spans a driven first roller and a second roller.

3. A printing machine according to claim 1, wherein said transfer station and cleaning station contact said photoreceptor adjacent said driven first roller.

4. A printing machine according to claim 1, wherein said photoreceptor is exposed between said transfer station and said cleaning station.

5. An electrophotographic printing machine, comprising:

a rotating photoreceptor having at least a first image area and a second image area, both for receiving toner, wherein said first image area is spaced from said second image area by an interdocument zone of length L;

a charging station for charging said first image area and said second image area to predetermined potentials;

an exposure station for exposing said first image area and said second image area with image data;

a plurality of N developers that are capable of producing N toner images on at least a first image area in N cycles of said first image area;

a transfer station for transferring said toner images on said first image area to a substrate during a fifth cycle; and a cleaning station for cleaning said first image area after said toner images are transferred to a substrate;

wherein physical contact between both said transfer station and said cleaning station with said photoreceptor occur within the distance L, and wherein said exposure station exposes said photoreceptor when said transfer station and said cleaning station are not both adjacent said interdocument zone.

6. A printing machine according to claim 5, wherein said photoreceptor is comprised of a belt that spans a driven first roller and a second roller.

7. A printing machine according to claim 5, wherein said transfer station and cleaning station contact said photoreceptor adjacent said driven first roller.

8. A printing machine according to claim 5, wherein said photoreceptor is exposed between said transfer station and said cleaning station.

* * * * *